US006755000B2

(12) United States Patent
Wone Hahn

(10) Patent No.: US 6,755,000 B2
(45) Date of Patent: Jun. 29, 2004

(54) PLASTER MOLDING SYSTEM

(76) Inventor: Richard Duk Wone Hahn, 553 Great Bend Dr., Diamond Bar, CA (US) 91765

( * ) Notice: Subject to any disclaimer, the term of this patent is extended or adjusted under 35 U.S.C. 154(b) by 0 days.

(21) Appl. No.: 10/302,397

(22) Filed: Nov. 22, 2002

(65) Prior Publication Data

US 2003/0070373 A1 Apr. 17, 2003

Related U.S. Application Data

(63) Continuation-in-part of application No. 09/909,451, filed on Jul. 18, 2001, now abandoned.

(51) Int. Cl.[7] ..... E04F 19/04
(52) U.S. Cl. ..... 52/287.1; 52/716.1
(58) Field of Search ..... 52/287.1, 288.1, 52/716.1, 272

(56) References Cited

U.S. PATENT DOCUMENTS

| | | | | |
|---|---|---|---|---|
| 1,249,500 | A | 12/1917 | Richter | |
| 1,315,260 | A * | 9/1919 | Tischler | 52/287.1 |
| 1,780,125 | A | 10/1930 | Goodhouse | |
| 1,917,139 | A | 7/1933 | McCutcheon | |
| 3,309,832 | A | 3/1967 | Filsinger | |
| 3,609,927 | A * | 10/1971 | Wine | 52/100 |
| 4,600,975 | A | 7/1986 | Roberts | |
| 5,001,877 | A * | 3/1991 | Edwards | 52/288.1 |
| 5,157,886 | A | 10/1992 | Azzar et al. | |
| 5,179,811 | A * | 1/1993 | Walker et al. | 52/288.1 |
| 5,199,237 | A | 4/1993 | Juntunen | |
| 5,226,724 | A | 7/1993 | Kanarek | |
| RE34,547 | E * | 2/1994 | Weldy | 52/288.1 |
| 5,287,667 | A | 2/1994 | Singhal | |
| 5,359,817 | A | 11/1994 | Fulton | |
| 5,457,923 | A | 10/1995 | Logan et al. | |
| 5,553,431 | A | 9/1996 | Pelosi, Jr. et al. | |
| 5,651,224 | A | 7/1997 | Brabant | |
| 5,694,726 | A | 12/1997 | Wu | |
| 5,823,655 | A | 10/1998 | Brooks | |
| D424,709 | S | 5/2000 | Minidis | |
| 6,228,507 | B1 | 5/2001 | Hahn | |
| 6,309,036 | B1 * | 10/2001 | Ancel | 312/140.4 |
| 6,405,503 | B1 * | 6/2002 | Reed | 52/288.1 |
| 2001/0045076 | A1 | 11/2001 | Boomer | |

* cited by examiner

*Primary Examiner*—Brian E. Glessner
(74) *Attorney, Agent, or Firm*—Gene Scott-Patent Law & Venture Group

(57) ABSTRACT

A plaster crown molding tile system has an upright body portion providing a front decorative surface and a rear wall-engaging surface. Integral with the body portion, a topper portion extends angularly upwardly. A first tile provides a laterally extensive linear portion, the rear wall-engaging surface of the linear portion configured for surface-to-surface contact with a generally flat wall. The linear portion terminates at one end with an integral corner-turning portion which is small in lateral proportion to the linear portion. The rear wall-engaging surface of the corner-turning portion is oriented for contact with a second generally flat wall usually set at a right angle to the first wall. The corner-turning portion terminates laterally with a non-mitered first edge, laying in a plane generally perpendicular to the second generally flat wall wherein the first edge abuts a linear tile with a second edge conforming to the first edge for forming a uniformly tight butt seam.

3 Claims, 5 Drawing Sheets

PLASTER MOLDING SYSTEM

RELATED APPLICATIONS

This is a continuation-in-part application of a prior filed and currently application having Ser. No. 09/909,451 and file date of Jul. 18, 2001, now abandoned.

BACKGROUND OF THE INVENTION

INCORPORATION BY REFERENCE

Applicant(s) hereby incorporate herein by reference, any and all U.S. patents, U.S. patent applications, and other documents and printed matter cited or referred to in this application.

FIELD OF THE INVENTION

This invention relates generally to crown molding and indirect lighting systems and more particularly to a plaster molding adapted for indirect lighting and a method for installation.

DESCRIPTION OF RELATED ART

The following art defines the present state of this field:

Minidis, U.S. D424,709 describes a cove base design.

Richter, U.S. Pat. No. 1,249,500 describes the combination of interior illumination with the walls of a room, of a removably light confining trough involving a supporting body structure designed to contact with and be securely fastened to the said walls, the lower portion of said body having provided with a ledge; suitable brace members secured to said body above the ledge; a radially disposed member consisting the exposed wall of the trough, which radial member is supported by the said brace members and aforesaid ledge; and lighting means concealed from view with the trough.

Goodhouse, U.S. Pat. No. 1,780,125 describes a fixture for indirect illumination, a moulding strip including a fixed section constituting a supporting and reflecting means for the source of illumination and a movable section for protecting and concealing the source of illumination and interengageable means of connection provided respectively on said sections, said fixed section having a strenghening flange projecting outwardly therefrom and disposed at an angle with an outer portion of the movable section with which it engages for strengthening and supporting purposes.

McCutcheon, U.S. Pat. No. 1,917,139 describes a new article of manufacture, a base tile comprising an upright body having its lower portion provided with a downwardly inclined lateral extension the end of which is formed with a transverse rabbet extending the entire width of the tile and opening through the top and front face of said extension to provide an open seat for floor surfacing material and an abutment at the end of the extension for engagement with a floor substructure, the walls of the rabbet being disposed at substantially right angles to each other and defining upper and lower straight edges, one of which indicates the level of the floor surfacing material and the other the level of the floor substructure.

Filsinger, U.S. Pat. No. 3,309,832 describes a ceramic trim element adapted for multi-purpose use in wail structures employing a plurality of ceramic tile assembled in a pattern, comprising: a ceramic body member including: a main body portion of uniform width having a front glazed surface, a glazed edge face, and a back unglazed surface; said main body portion having adjacent said glazed edge face a longitudinal edge section of reduced thickness providing a longitudinally extending front surface recess; and a leg portion projecting from the back surface of the main body portion at the edge opposite the reduced edge section and generally normal thereto, said leg portion having uniform width for the length of the main body portion and having an outer glazed surface merging with the outer glazed surface of the main body portion, a glazed edge face and a sloping unglazed back face merging with the back unglazed surface of the main body portion.

Roberts, U.S. Pat. No. 4,600,975 describes an indirect lighting assembly consisting of a housing structure and low voltage light tubing for retention therein, said housing structure being a unitarily extruded body having an anchor tab portion extending perpendicularly into a spacer portion and terminating in a light tube housing portion having an open area directing light generally perpendicular to the plane of said spacer portion.

Azzar et al., U.S. Pat. No. 5,157,886 describes an extruded, thermoplastic baseboard elastomeric molding strip having opposed generally flat front and rear surfaces is provided with a plurality of closely vertically, spaced horizontal, parallel ribs projecting outwardly of the flat front surface over the full surface area thereof. The strip is formed of front and rear surface layers of thermoplastic material of the same durometer hardness with the front surface layer forming at least the tips of the front surface ribs being of a low density thermoplastic material and the balance of the strip being of high density thermoplastic material. The front and rear surface layers may be of contrasting colors. The rear surface of the strip is preferably formed with concave grooves separated by a multiplicity of fine, vertically spaced horizontal, parallel rearwardly projecting ribs with a rear, center rib between adjacent fine ribs, of a larger diameter than adjacent fine ribs separating the rear surface grooves. The rear surface configuration facilitates removing of excess wet adhesive and maintenance of flush adhesive mounting of the molding strip to a building vertical wall.

Juntunen, U.S. Pat. No. 5,199,237 describes a decorative receptacle covering and providing the appearance of a finished joint between the adjacent rough cut ends of two lineal moldings. The receptacle slidably receives the ends of the lineal moldings, covers the ends and allows cutting the moldings to a rough length and rough end cut, thereby reducing or eliminating the need for precision carpentry skills by one installing the moldings. Receptacles can be made for a wide variety of decorative moldings including casing moldings, base moldings, chair rail moldings, and crown moldings.

Kanarek, U.S. Pat. No. 5,226,724 describes a modular, fluorescent, indirect lighting system which may be easily mounted to most surfaces by the user, without any technical knowledge or experience, using just a screwdriver and measuring tape. The system is comprised of a family of plug-in modules, each of which contain an integral power bus, that provides power continuity to the adjacent module, and a gender conversion plug that allows the installer to configure each module so that power is supplied only from female connectors. The system includes a power source module and three sizes of illumination modules, which house single 20, 30 or 40 watt lamps, as well as inside and outside corner modules and both straight and corner adjustable-length modules. Modules selected from this family can be plugged together to create a cove lighting system for a room of almost any size or shape. The complete installation is powered by a neat line cord plugged into a standard wall outlet. And, each module can accommodate a continuous decorative facing strip that both enhances the appearance and conceals the modular nature of the system.

Singhal, U.S. Pat. No. 5,287,667 describes a tile for waterproofing the juncture of a tiled surface and a non tiled surface such as a tub and tile juncture by use of a water proof tile. The waterproof tile consists of a glazed tile surface having a curvature which directs the water away from the juncture, a non glazed surface which is cemented to the tiled wall and a bottom side which holds sealant for sealing against the non tiled surface.

Fulton, U.S. Pat. No. 5,359,817 describes trim moldings such as crown molding, chair rail molding, base molding and door casing for a building. The trim moldings are made of substantially acrylic or polyester rigid thermoset polymer components. The trim moldings may be manufactured to realistically visually simulate moldings made of natural stone. A method of manufacture of the moldings may utilizes bulk slabs or blocks of rigid thermoset polymer based materials which are then properly shaped for use as a building trim molding with mechanical material removal methods such as sawing, cutting, sanding, and polishing to achieve the desired size, shape and appearance of molding. The thermoset polymer based moldings are structured with grooves in the backside, with the grooves sized and positioned to snap onto spring biased members of mounting fixtures attached to the building for a removable attachment of the moldings.

Logan et al., U.S. Pat. No. 5,457,923 describes a decorative molding for a corner formed by a ceiling and a vertical wall comprising a thin strip of flexible plastic and is secured to the wall by an attachment allowing the molding strip along its upper and lower edges to be flexible to conform with uneven surfaces in the ceiling and/or wall. In one form the strip is attached to the wall by an adhesive. In another form, a wall track and clip arrangement is utilized to provide easy removal from the wall for paint or wallpaper application. A corner element is provided in one form in which ends of the strips are adhesively secured thereto in overlapping engagement. In another embodiment, the strips are telescopically connected to the corner element.

Pelosi, Jr. et al., U.S. Pat. No. 5,553,431 describes a fabricated structural beam including at least one longitudinally folded member having a web portion and a head portion. In different embodiments, a plurality of folded members may be interleaved with one another to provide configurations of varying load carrying capabilities. In all cases, the folded head portion is made rigid by forming it into a tube that is closed on all sides.

Brabant, U.S. Pat. No. 5,651,224 describes an architectural molding assembly comprising of straight molding pieces having a decorative outer surface and a channel in the rear surface thereof. A wall attaching plate is slidingly secured in the channel and has a slot or an aperture therein to engage with a fastener which is secured to a wall. The fastener may be in the form of a screw or a clamp having a projecting finger. When the attaching plates are engaged by the fasteners they are urged against the wall and maintained there under tension. No nail is inserted in the molding and molding connecting pieces and accordingly the assembly can be easily dismantled and remounted when desired.

Wu, U.S. Pat. No. 5,694,726 describes a plastic plate assembly used in fitting including a flat and linear retainer plate and a casing having curved surfaces. The retainer plate has an L-shaped retaining strip bending inwardly from either lateral side thereof. Correspondingly, the casing has an L-shaped retaining strip bending outwardly from either lateral side thereof for fitting onto the L-shaped retaining strip. The casing further has one of the lateral sides extending to form a soft extension strip at an end portion thereof. The retainer plate is mounted on the wall first and the casing is secured thereto by means of its L-shaped retaining strips fitting into the L-shaped retaining strips of the retainer plate, with the soft extension strip lying close against the wall to conceal any gaps between the casing and the wall.

Brooks, U.S. Pat. No. 5,823,655 describes a decorative lighting trim system comprising an assemblage of architectural moldings having a viewable surface which is structured to simulate an architectural trim or molding. The architectural molding is configured to retain lights, and to retain and conceal interconnecting electrical wiring to electrify the lights, in a manner which permits the attachment of the architectural moldings to a building surface. Because the architectural moldings are constructed to appear like conventional trims or moldings, the lighting system is virtually inconspicuous when attached to a house, building or other architectural structure, such as a fence or garage. The architectural moldings are in modular sections having varying selected lengths which allow the user to select the appropriate number and length of modular sections to extend along a given building surface, such as an eave, gable or window. The modular architectural molding assemblage is designed to be affixed relatively permanently to a building to eliminate the need for yearly seasonal hanging of lighting trim.

Hahn, U.S. Pat. No. 6,228,507 describes a prefabricated crown molding strip designed to facilitate one-person installation and composed of plaster that is reinforced by two layers of fiber reinforcement, one of bulk fiberglass intermixed throughout the outer portion of the strip and the ornamentation thereon and a second of a sheet of fiberglass netting generally centrally located as a spine in the strip and substantially coextensive therewith. Two side surfaces of the strip are disposed generally in perpendicular planes for engagement with a wall and a ceiling, and have patterns of longitudinally extending ribs and grooves of predetermined depths for facilitating adhesive mounting of the strip, and also facilitating selective removal of plaster to accommodate irregularities on supporting surfaces. Pre-formed nail holes are molded in preselected nailing locations. Also the method of making crown molding strips in steps providing the above characteristics, in a sequence of pours of plaster in fluid state, the addition of the reinforcing fiber, and formation of the patterns of ribs and grooves.

Boomer, U.S. 2001/0045076 A1, describes a building component that is in the form of an elongate prefabricated cornice to be used in lengths around the top of a wall or walls or a room. The cornice has a mounting part and a facing part. The mounting part has a cross-section with two legs at an angle to each other. The outer edge of each leg terminates in a reflexive bend with the outer portion of the bends inwardly directed. The facing part is a strap of material capable of being snap-fitted into or slid along the mounting part with the inside of each bend serving as a seat to receive a longitudinal edge of the facing part. A corner-piece is provided to join two adjacent lengths of cornice at a corner, the corner-piece being in two parts having a wall-mountable angle bracket and a correspondingly angled cornice part to be secured thereto.

Stovax Limited, GB 2274860 describes a cornice that is formed of a series of similar ceramic elements arranged end-to-end. Each ceramic element has parallel flat ends, a concave decorative front face and a rear face. The elements are of substantiallyuniform transverse cross section and are symmetrical about a central longitudinal axis. The rear face is bounded by a pair of flat, longitudinally extending marginal bonding surfaces which lie on mutually perpendicular planes. Each of the bonding surfaces joins a mutually perpendicular flat abutment face respectively which in turn join the front face. The length of each cornice element may equal tha of a wall tile.

The prior art teaches the use of artistic moldings for room appearance enhancement. The prior art teaches the use of corner pieces for adapting generally long linear tiles to a corner of a room. The prior art does not teach a linear tile having a built-in corner turning portion. The present invention fulfills these needs and provides further related advantages as described in the following summary.

SUMMARY OF THE INVENTION

The present invention teaches certain benefits in construction and use which give rise to the objectives described below.

Plaster crown molding tiles of the present invention are mounted to wall surfaces within rooms and may be placed directly in the corner between the wall surface and the ceiling surface or, alternately placed so that the topper portions are spaced downwardly apart from the ceiling surface leaving a space for indirect lighting. The surfaces of walls are typically not quite planar and may be misaligned and may have rough surface textures. This presents a problem in mounting the tiles since mounting surface roughness can cause adjacent tiles to be misaligned at butt joint seams, i.e., one tile may jut out from the wall surface slightly more than its neighbor. Additionally, at wall corners, where one wall meets a second wall, usually at an approximate angle, the abutting tiles must be mitered. This can be a problem since both of the adjacent tiles that are fitted together in the corner must be cut on a 45 degree angle. An alternate common solution to this problem is to use a corner piece, which is a small part having the same general height and shape as the linear molding tiles used with it. However, such a corner piece presents the further problem of matching three abutting tiles and presents two seams placed quite near to each other. Again, due to lack of wall planarity, smoothness and squareness, such corner tiles exaggerate the above stated problem.

The tiles may be unable to be fitted for proper appearance without significant work. The instant solution is to provide a plaster crown molding tile system where a first tile provides a laterally extensive linear portion, the rear wall-engaging surface of the linear portion configured for surface-to-surface contact with a first generally flat wall. The linear portion terminates at one end with an integral corner-turning portion which is small in lateral proportion to the linear portion. The rear wall-engaging surface of the corner-turning portion is oriented for contact with a second generally flat wall usually set at a right angle to the first wall. The corner-turning portion terminates laterally with a non-mitered first edge, laying in a plane generally perpendicular to a second generally flat wall wherein the first edge abuts a linear tile with a second edge conforming to the first edge for forming a uniformly tight butt seam.

The present invention overcomes the latter problem by providing a tile constructed as a corner tile, but having one leg of standard length. This provides the advantage of turning the corner with only one seam and only one set of abutting surfaces to match angularly and in depth in the difficult corner area. It results in an improved appearance and is easier to install.

A primary objective of the present invention is to provide an apparatus and method of use of such apparatus that provides advantages not taught by the prior art.

Another objective is to provide such an invention capable of being more easily fitted to non-planar surfaces.

A further objective is to provide such an invention capable of being fitted to inside and outside corners with improved butt joint appearance and requiring less work for effectuating this.

A still further objective is to provide such an invention capable of providing all of the tiles needed for installing a continuous molding around a room with fewer different tile styles.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
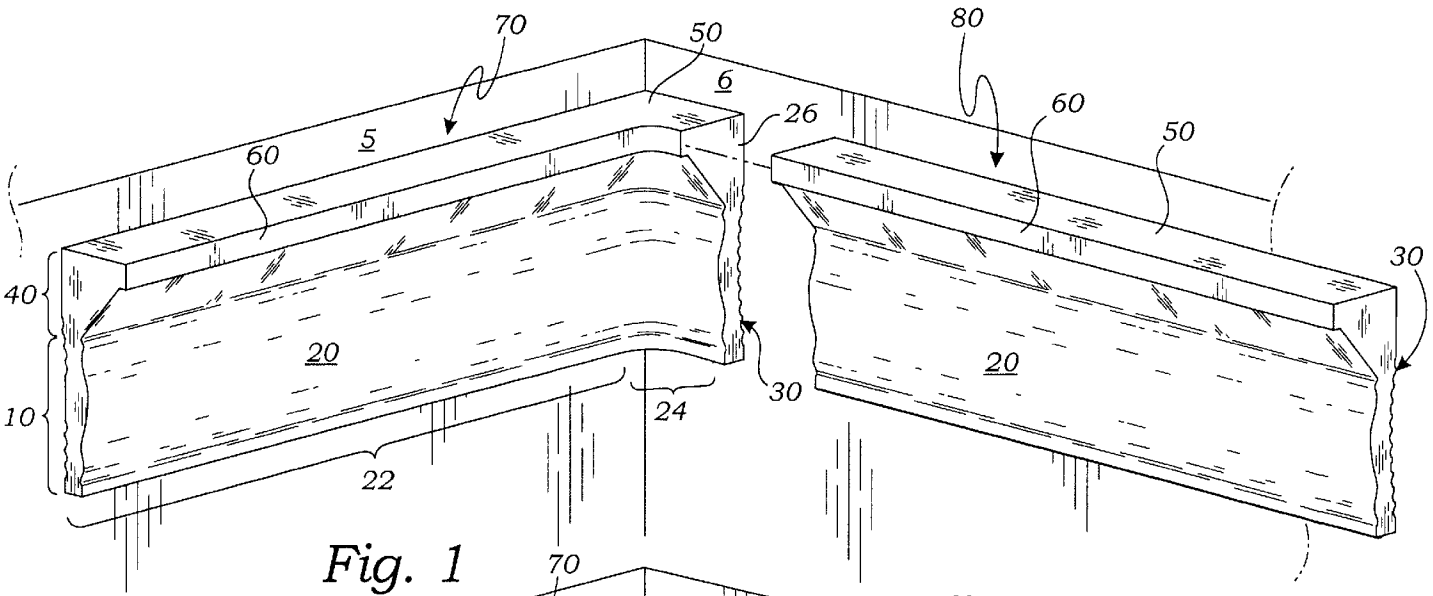
FIGS. 1 and 2 are perspective exploded views of a first and a second preferred embodiments of the invention for mounting on an inside wall surface corner of a room.
Figure 2:
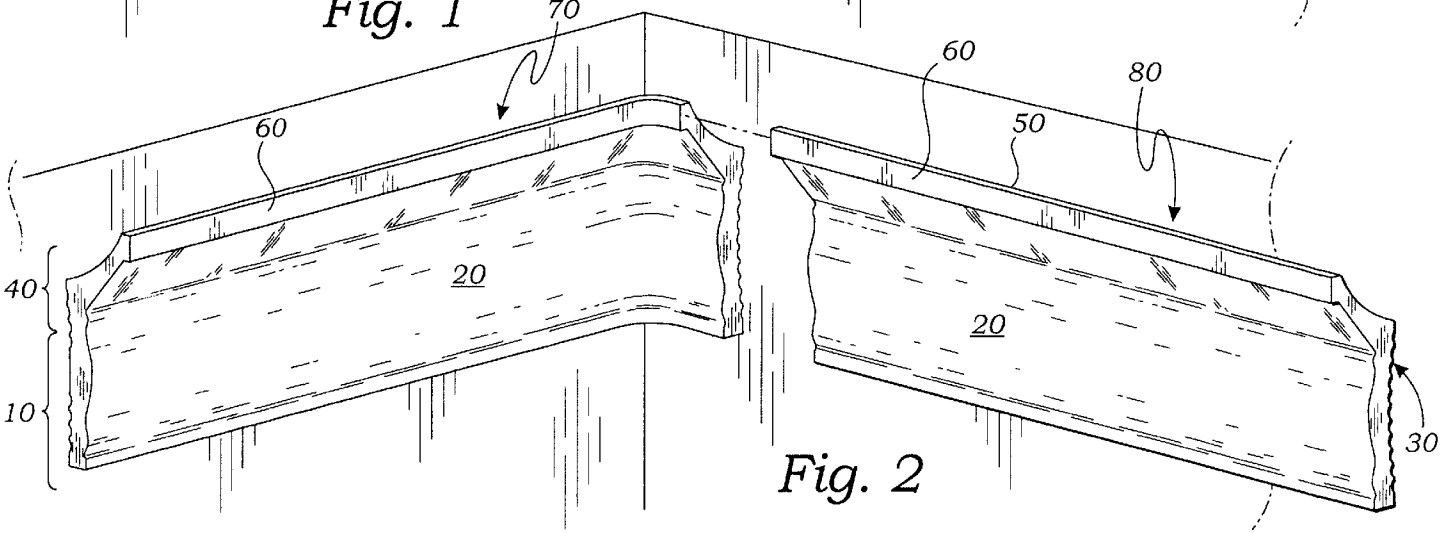
Figure 3:
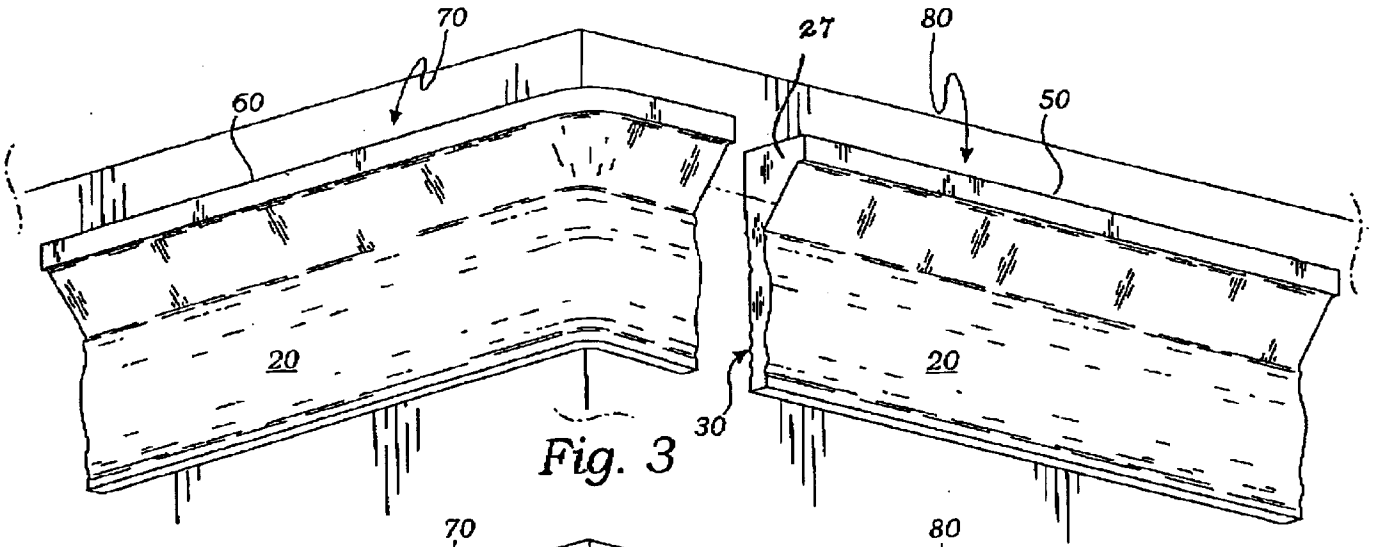
FIGS. 3 and 4 are perspective exploded views of the first and a second preferred embodiments of the invention for mounting on an outside wall surface corner of a room.
Figure 4:
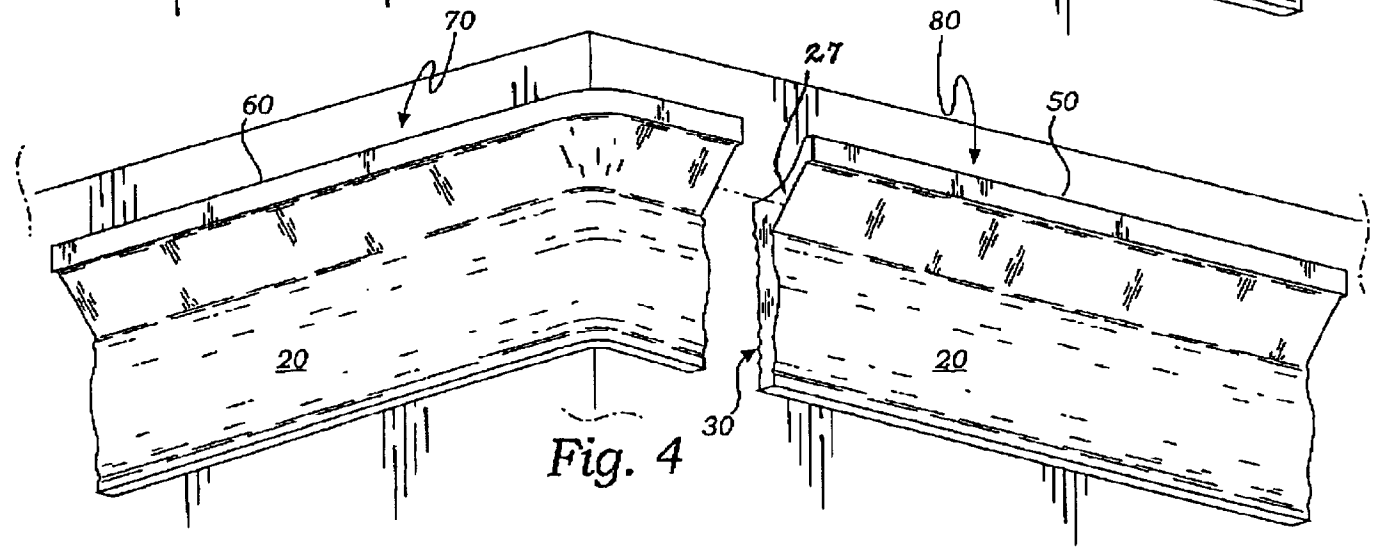

The above described drawing figures illustrate the invention in at least one of its preferred embodiments, which is further defined in detail in the following description.

The present invention is a plaster crown molding apparatus and system. Now referring to FIGS. 1–4, the separate pieces shown are referred to herein as tiles of the system. They each comprise an upright body portion 10 integral with a topper portion 40. A front decorative surface 20 faces outwardly from a wall surface 5 upon which the pieces are mounted. In opposition to the front surface 20, there is a rear wall-engaging surface 30. Because walls tend to be bowed or cupped (non-planar), and non-aligned and have rough surfaces, abutting tiles mounted thereon generally do not form perfectly matched butt joint seams. Three types of seam discrepancies exist. First, the top surfaces 50 of the abutting tiles may not be coplanar so that a seam crack tends to diverge upwardly or downwardly. Second, the front decorative surfaces 20 may not be at right angles, so that the seam may not be closed at the front face 20, or if closed at the front face a wider gap will exist at the rear surface 30 and closure of the seam at the front surface 20 will vary along the seam due to surface non-planarity. The third seam problem occurs when the abutting wall surfaces 5 are not mutually vertical or are not mutually aligned off the vertical so that the seam is only in true alignment at one point and unaligned at all other points. These three alignment difficulties are grossly exaggerated near corners and when making a butt joint with a pair of tiles when one tile is mounted to one of the walls at the corner while the second is mounted to the opposing wall at the corner. To complicate matters further, the molding process for plaster parts does not result in identical sizes such as the lengths identified by upright body portion 10 and topper portion 40, or thicknesses of the several portions of the tiles, because of mold variations and also variations in the plaster mix and ratios, drying rate and other variables in production. The present invention reduces the number of seams required at a corner from two, using the prior art method of inserting a corner piece, to one, a reduction of 50%, and this results in a reduction of the same order of magnitude in the applied labor necessary to achieve a perfect seam match. Of course, this results in significant savings to the end user.

Figure 8:
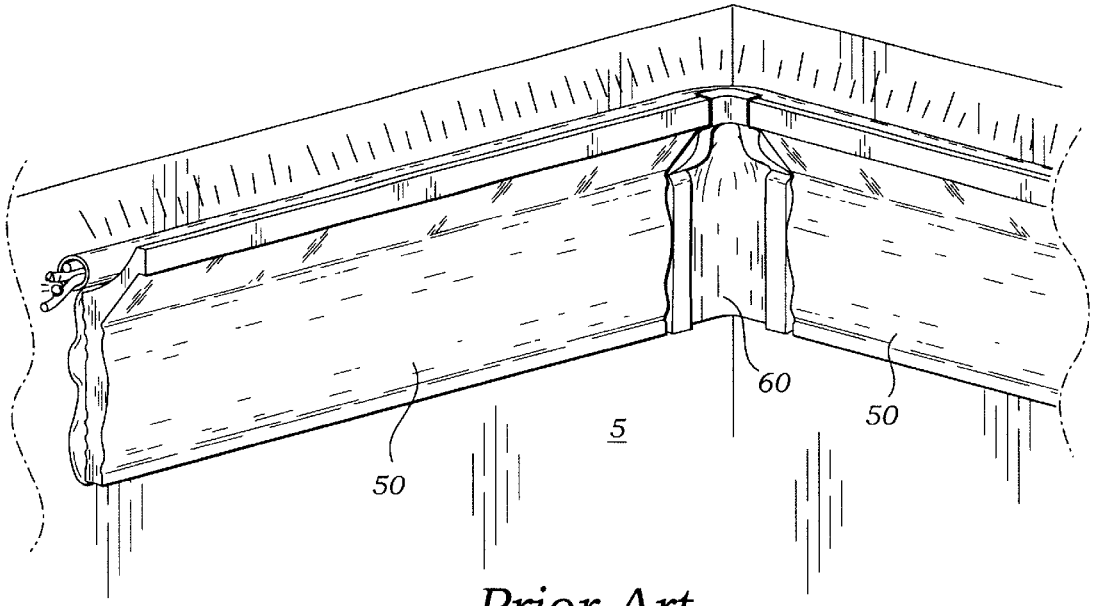
Prior Art Fig. 8
FIG. 8 is a perspective view of a prior art method of making an inside corner turn.
Figure 9:
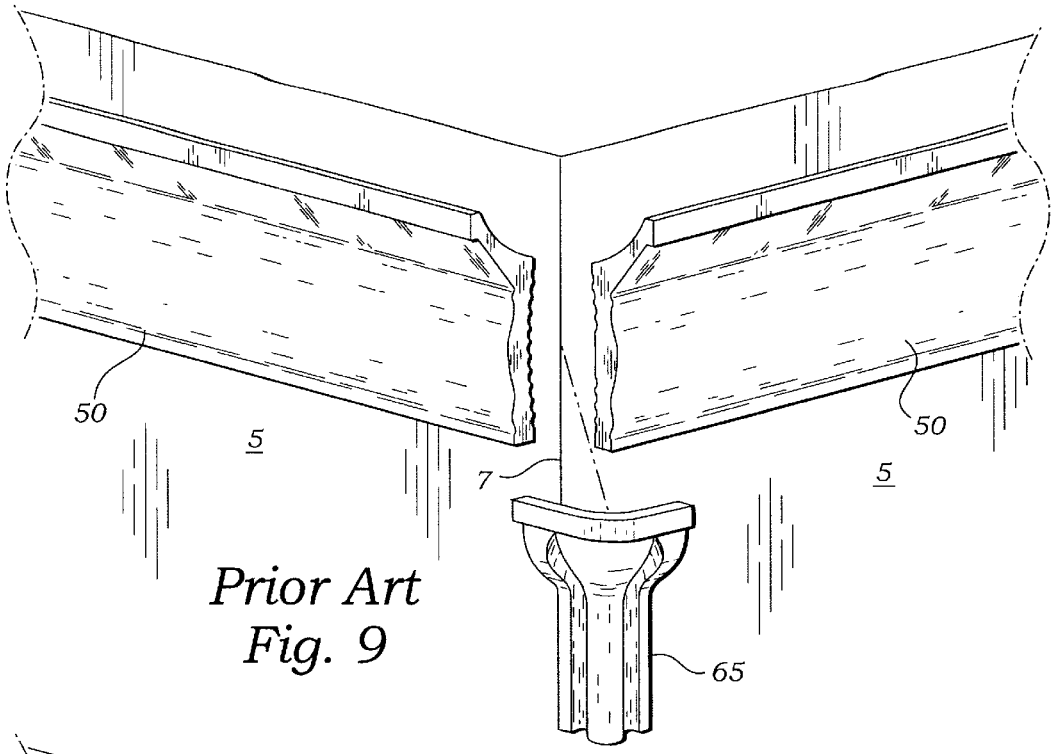
Prior Art Fig. 9
FIGS. 9 and 10 are perspective views of a prior art method of making an outside corner turn.
Figure 10:
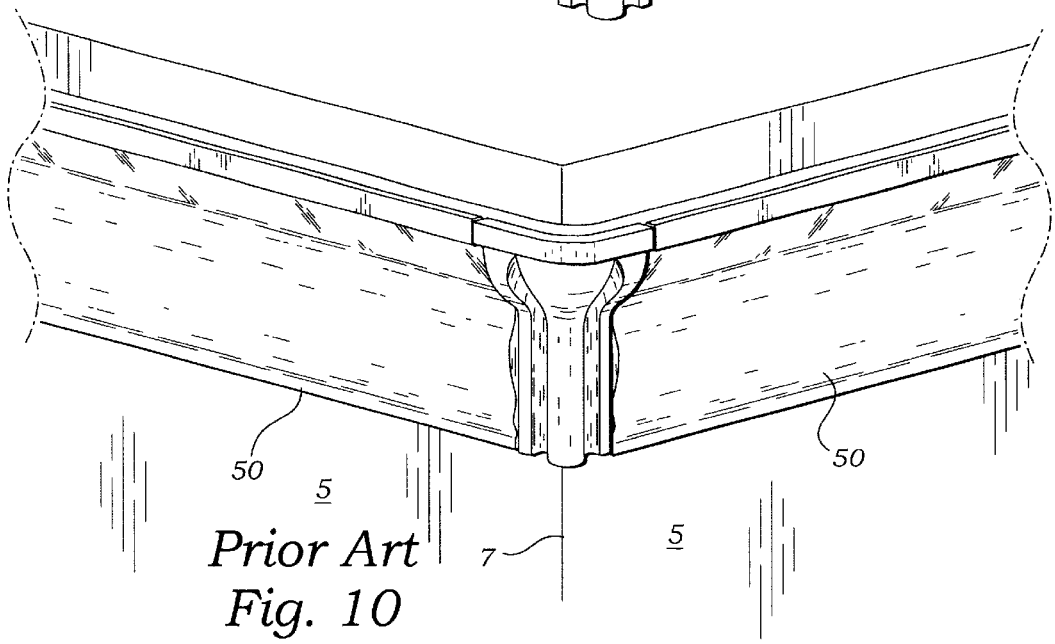
Prior Art Fig. 10

In the prior art, as shown in FIGS. 8–10, a corner tile, numeral 60 for inside corner in FIG. 8, and numeral 65 for an outside corner in FIGS. 9 and 10, are used to make a corner turn. It is noted that this method requires two seams between the three tiles used, and at a place where it is more likely that wall surface planarity, angle disparity, and roughness problems will be at their worst.

Figure 5:
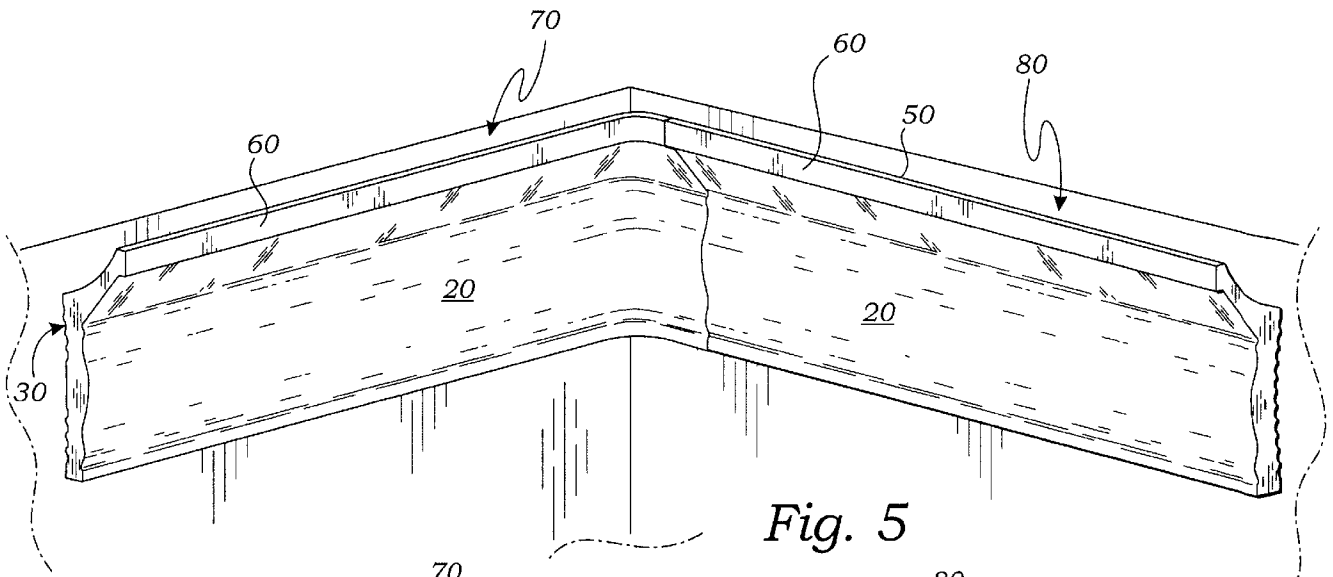
FIGS. 5 and 6 are perspective views showing the elements of FIGS. 2 and 4 after installation.
Figure 6:
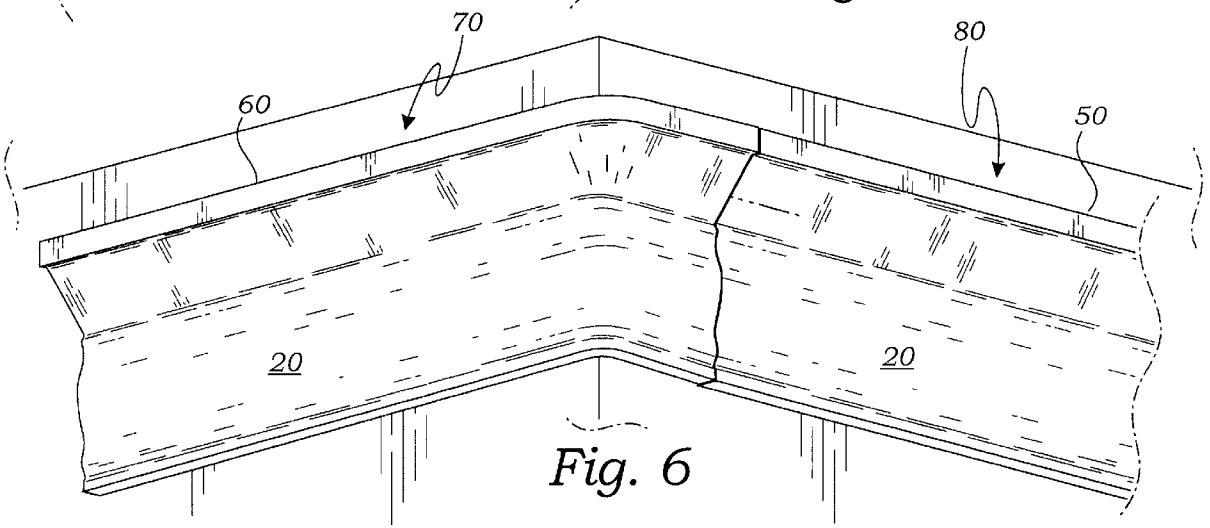

In the present invention, a long-leg corner tile 70 is butted to a standard linear tile 80 so that only one butt joint is required to make the corner turn, as shown in FIGS. 5 and 6. The three types of seam abutment problems described above are still just as likely, but now only one seam need be attended to, i.e., adjusted, cut, modified, sanded, etc. In FIGS. 5 and 6 it is seen that only one seam is positioned in the critical corner area.

The element that makes this possible is the use of a standard linear tile like that shown in FIG. 1 as numeral 80, and incorporating a corner turning portion on it to achieve the tile shown in FIG. 1 numeral 70, the so-called, long-leg corner tile.

The long-leg corner tile 70 provides the front decorative surface 20 and, in opposition thereto, the rear wall-engaging surface 30 as described above. A linear portion 22 terminates at one end thereof with an integral corner-turning portion 24, wherein the corner-turning portion 24 is small in lateral proportion to the linear portion 22. The rear wall-engaging surface 30 of the corner-turning portion 24 is oriented at an angle, normally 90 degrees, with respect to the rear wall-engaging surface 30 of the linear portion 22 of the tile 70, for contact with a second generally flat wall 6, the corner-turning portion terminating laterally with a non-mitered first edge 26, said edge laying in a plane generally perpendicular to the second generally flat wall 6, wherein the first edge 26 abuts the linear tile 80. The linear tile 80 provides a second edge 27, which conforms to the first edge 26 for forming a uniformly tight butt seam.

Figure 7:
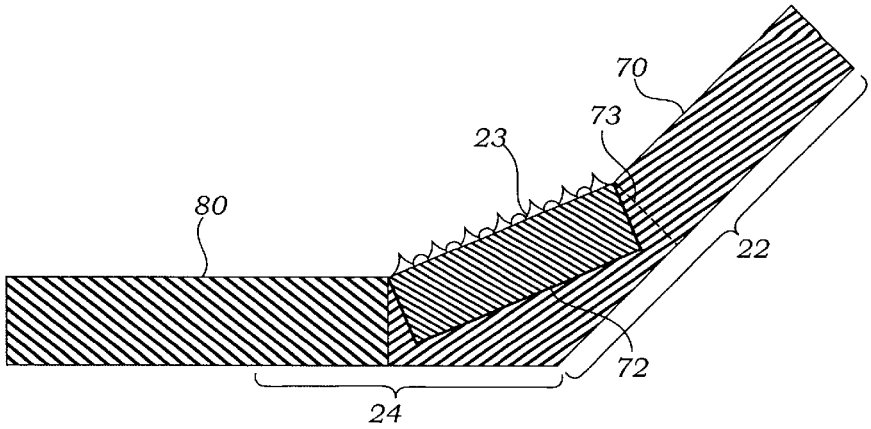
FIG. 7 is a top plan section view thereof showing a facia insert.

In one preferred embodiment shown in FIG. 7, the tile 70 provides a frontal recess 72 within the front decorative surface 20 at the corner, for accepting a frontal decorative insert 23, basically a block preferably with decorative out-facing surface, which is adapted for fitting tightly within the frontal recess 72. Such an insert 23 enables the tile 70 to be adapted at the corner-turning portion 24 for various decorative modifications without requiring the entire tile 70 to be molded in many different ways. In this embodiment the corner turning portion of tile 70 may be an abbreviated piece with no long leg, i.e., cut at line 73 (FIG. 3) so that the part has full symmetry left to right.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A molding tile apparatus for mounting onto a pair of abutting wall surfaces forming an outside corner, the apparatus comprising: an upright body portion providing a front decorative surface and, in opposition thereto, a rear wall-engaging surface; and integral with the body portion, a topper portion extending angularly upwardly and outwardly from the body portion; the body portion and the topper portion configured as a linear lateral portion terminating at one end thereof at a corner turning portion; the rear wall-engaging surface of the linear lateral portion configured for contacting one of the abutting wall surfaces, and the rear wall-engaging surface of the corner turning portion configured for contacting the other of the abutting wall surfaces; the corner turning portion providing a frontal recess having a decorative insert removably inserted therein.

2. A molding tile apparatus for mounting onto a pair of abutting wall surfaces forming an inside corner, the apparatus comprising: an upright body portion providing a front decorative surface and, in opposition thereto, a rear wall-engaging surface; and integral with the body portion, a topper portion extending angularly upwardly and outwardly from the body portion; the body portion and the topper portion configured as a linear lateral portion terminating at one end thereof at a corner turning portion; the rear wall-engaging surface of the linear lateral portion configured for contacting one of the abutting wall surfaces, and the rear wall-engaging surface of the corner turning portion configured for contacting the other of the abutting wall surfaces; the corner turning portion providing a frontal recess having a decorative insert removably inserted therein.

3. A molding tile apparatus for mounting onto a pair of abutting wall surfaces forming a corner, the apparatus comprising: an upright body portion providing a front decorative surface and, in opposition thereto, a rear wall-engaging surface; the body portion and the topper portion configured as a linear lateral portion terminating at one end thereof at a corner turning portion; the rear wall-engaging surface of the linear lateral portion configured for contacting one of the abutting wall surfaces, and the rear wall-engaging surface of the corner turning portion configured for contacting the other of the abutting wall surfaces; the corner turning portion providing a frontal recess having a decorative insert removably inserted therein.

* * * * *